US012648635B1

(12) United States Patent
Levy et al.

(10) Patent No.: US 12,648,635 B1
(45) Date of Patent: Jun. 9, 2026

(54) SPRAYER HAIRBRUSH

(71) Applicant: LEVCO LLC, Boca Raton, FL (US)

(72) Inventors: Orlie Levy, Boca Raton, FL (US); Alexandra Cohen, Boca Raton, FL (US)

(73) Assignee: Levco LLC, Boca Raton, FL (US)

( * ) Notice: Subject to any disclaimer, the term of this patent is extended or adjusted under 35 U.S.C. 154(b) by 166 days.

(21) Appl. No.: 18/418,306

(22) Filed: Jan. 21, 2024

(51) Int. Cl.
*A46B 11/00* (2006.01)
*A45D 24/28* (2006.01)
*A46B 9/02* (2006.01)

(52) U.S. Cl.
CPC ..... *A46B 11/0055* (2013.01); *A45D 24/28* (2013.01); *A46B 9/023* (2013.01); *A46B 9/025* (2013.01); *A46B 9/026* (2013.01); *A46B 11/0072* (2013.01); *A45D 2200/057* (2013.01); *A46B 2200/104* (2013.01)

(58) Field of Classification Search
CPC ..... A46B 11/0055; A46B 11/0062; A46B 11/0065; A46B 2200/104
See application file for complete search history.

(56) References Cited

U.S. PATENT DOCUMENTS 1,392,369 A * 10/1921 Stoewsand ..... A46B 11/0055 401/150
4,893,957 A * 1/1990 Byriel ..... A46B 11/0058 401/149
4,934,855 A * 6/1990 Recchelbacher .. A46B 11/0055 132/148
5,622,192 A * 4/1997 Chiou ..... A46B 11/0058 222/509
5,927,290 A * 7/1999 Thiruppathi ..... A46B 11/0017 401/140
6,227,740 B1 * 5/2001 Stear ..... A46B 11/002 401/187
7,011,468 B1 * 3/2006 Leventhal ..... A46B 11/0017 401/137
2008/0041416 A1 * 2/2008 Mathews ..... A46B 11/0055 15/159.1

(Continued)

FOREIGN PATENT DOCUMENTS

WO WO-2021149963 A1 * 7/2021 ..... A46B 11/0096

OTHER PUBLICATIONS

Machine Translation of WO2021/149963 (Year: 2021).*

*Primary Examiner* — David P Angwin
*Assistant Examiner* — Bradley S Oliver
(74) *Attorney, Agent, or Firm* — Bamert Regan PLLC

(57) ABSTRACT

Embodiments are directed toward a hairbrush. In some embodiments, the hairbrush has a brush body with a head portion and a handle portion. The hairbrush also includes a bristle component coupled to the head portion of the brush body. The bristle component includes a plurality of bristles and forms an aperture. A reservoir couples to the handle portion. The reservoir is configured to receive a liquid. A trigger actuator is coupled to the brush body. A pump is housed by the handle portion. The pump is actuated by the trigger actuator and is configured to receive the liquid from the reservoir. A spray nozzle is located adjacent to the aperture of the bristle component. The spray nozzle is configured to receive the liquid from the pump and to spray the liquid in response to actuation of the trigger actuator.

18 Claims, 8 Drawing Sheets

(56) References Cited

U.S. PATENT DOCUMENTS

| | | | | |
|---|---|---|---|---|
| 2011/0070016 | A1* | 3/2011 | Richardson | A46B 11/0079 401/282 |
| 2019/0289992 | A1* | 9/2019 | Thiruppathi | A46B 11/0055 |

* cited by examiner

SPRAYER HAIRBRUSH

FIELD OF THE INVENTION

The invention relates generally to hairbrushes and, more particularly, to hairbrushes with an integrated sprayer.

BACKGROUND OF THE INVENTION

Hairbrushes are often used to style hair. As part of the hair styling process, a user may apply a liquid to hair. Typically, the liquid is contained in a bottle with a spray attachment. To apply the liquid, a user must actuate a liquid dispenser on the spray bottle. Therefore, at least two hands must be used to simultaneously spray liquid using the spray bottle and brush hair with the hairbrush. This prevents a user's hand from performing other operations such as positioning hair.

Furthermore, a user may use a hairdryer or other accessory to style hair. In these cases, the user may have one accessory in one hand and a hairbrush in another hand. When the user wants to apply liquid to the hair, the user must put the hairbrush or accessory down to then use the spray bottle. This leads to inefficient transitioning between multiple devices. Additionally, having a separate hairbrush and spray bottle results in increased clutter in a user's work area.

For these reasons, there is a need for hairbrushes that generate a spray of liquid. There is also a need for hairbrushes that generate the spray of liquid in an ergonomic manner. Furthermore, there is a need for hairbrushes that allow for precise aiming of a liquid spray on the hair that is being styled.

SUMMARY OF THE INVENTION

It is therefore an object of the present invention to provide hairbrushes that contain and spray a liquid.

It is also an object of the present invention to provide hairbrushes that achieve the above object and that also easily generate the liquid spray.

It is a further object of the present invention to provide hairbrushes that achieve the above objects and allow for precise application of the liquid spray on hair that is being styled.

The invention achieves the above objects, as well as other objects and advantages that will become apparent from the description that follows, by providing a hairbrush. The hairbrush has a brush body with a head portion and a handle portion. The hairbrush also includes a bristle component coupled to the head portion of the brush body. The bristle component includes a plurality of bristles and forms an aperture. A reservoir couples to the handle portion. The reservoir is configured to receive a liquid. A trigger actuator is coupled to the brush body. A pump is housed by the handle portion. The pump is actuated by the trigger actuator and is configured to receive the liquid from the reservoir. A spray nozzle is located adjacent to the aperture of the bristle component. The spray nozzle is configured to receive the liquid from the pump and to spray the liquid in response to actuation of the trigger actuator.

In some embodiments, the spray nozzle is configured to generate a mist of the liquid. The spray nozzle provides a single spray of the liquid for the hairbrush.

In some embodiments, the aperture is located in a central region of the bristle component. In some embodiments, the bristle component includes a bristle-free region surrounding the aperture. The liquid spray in the bristle-free region is unobstructed by the bristles.

In some embodiments, the trigger actuator includes a pivot pin, and wherein the brush body includes a pivot pin receiver to receive the pivot pin and allow rotation of the trigger actuator about the pivot pin. In some embodiments, a shield surrounds the pivot pin of the trigger actuator. The shield is configured to restrict hair from engaging the pivot pin and becoming tangled on the pivot pin.

In some embodiments, the reservoir is configured to be removable from the handle portion. In some embodiments, the reservoir includes threads configured to couple to threads of the handle portion.

In some embodiments, the head portion of the brush body defines an internal cavity of the hairbrush. In some embodiments, a nozzle housing is coupled to the head portion within the internal cavity. The nozzle housing is configured to couple to the spray nozzle and to position the spray nozzle adjacent to the aperture of the bristle component.

The invention also achieves the above objects, as well as other objects and advantages that will become apparent from the description that follows, by providing a hairbrush with a first tube coupled to an inlet of the pump. The first tube is configured to insert into the reservoir to transmit the liquid from the reservoir to the pump.

In some embodiments, a second tube is coupled to an outlet of the pump and an inlet of the spray nozzle. The second tube provides fluidic communication between the pump and the spray nozzle.

In some embodiments, the pump includes a first ball to allow the liquid to enter the pump through the inlet and to restrict the liquid from exiting through the inlet. A second ball allows the liquid to exit the pump through the outlet and restricts the liquid from entering the pump through the outlet. In some embodiments, the pump includes a first spring to provide a bias to the first ball. The pump also includes a second spring to provide a bias to the second ball.

In some embodiments, the pump includes a piston configured to contact the trigger actuator. The piston translates along an axis in response to actuation of the trigger actuator. The pump also includes a third spring to provide a bias to the piston to cause the trigger actuator to return to a first position.

The invention also achieves the above objects, as well as other objects and advantages that will become apparent from the description that follows, by providing a method of using a hairbrush. The reservoir is filled with liquid. The reservoir is then attached to the handle position. Actuating the trigger actuator causes the pump to receive the liquid from the reservoir. The pump provides the liquid to the spray nozzle to generate a spray of liquid.

In some embodiments, actuating the trigger actuator causes the spray nozzle to generate a mist in the central region of the bristle component.

In some embodiments, attaching the reservoir to the handle portion includes threading threads on the reservoir to threads on the handle portion.

In some embodiments, a first tube coupled to an inlet of the pump is inserted into the reservoir before attaching the reservoir to the handle portion.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
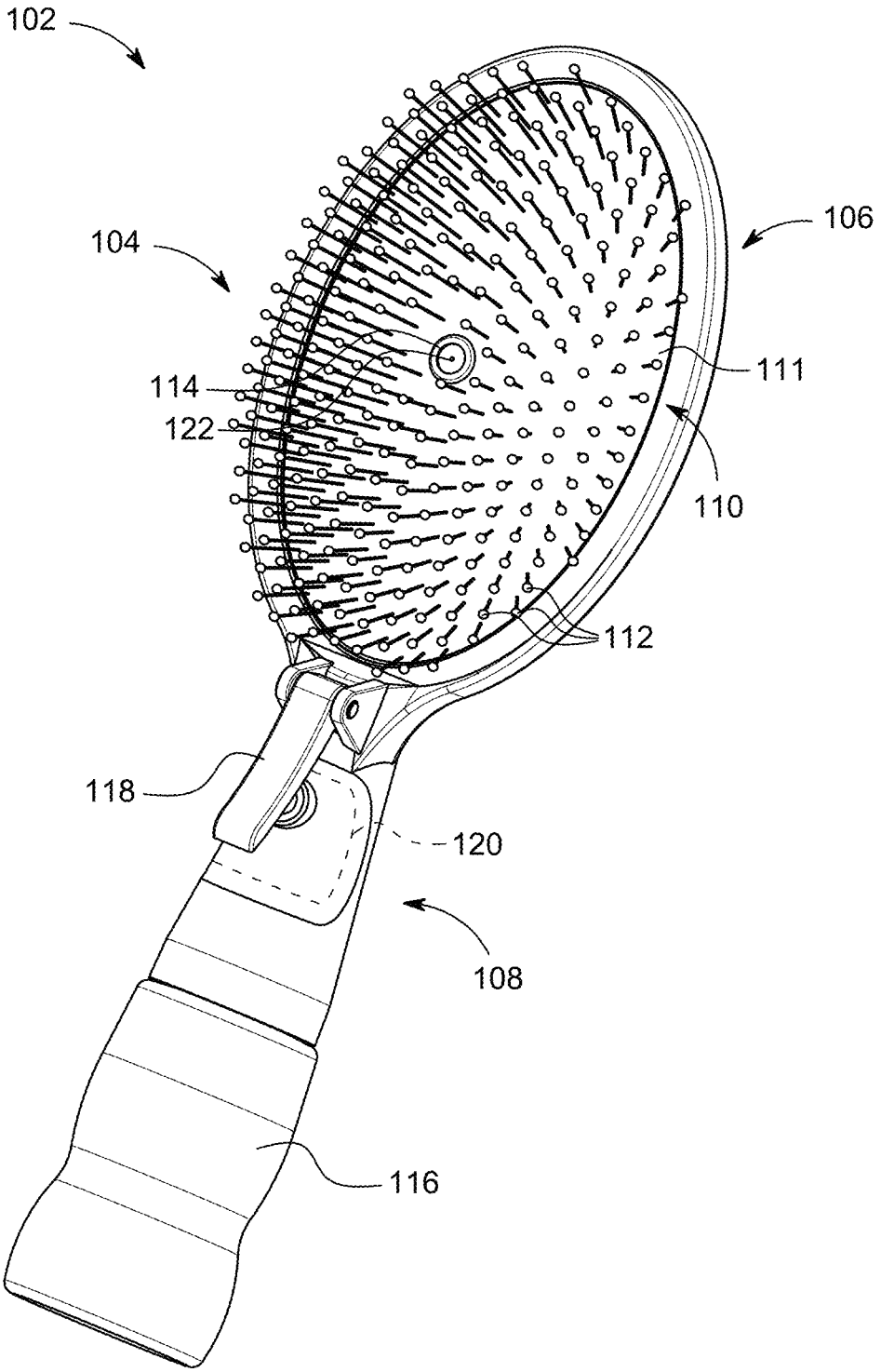
FIG. 1 is an isometric perspective view of a first embodiment of a hairbrush in accordance with the principles of the invention.
Figure 2:
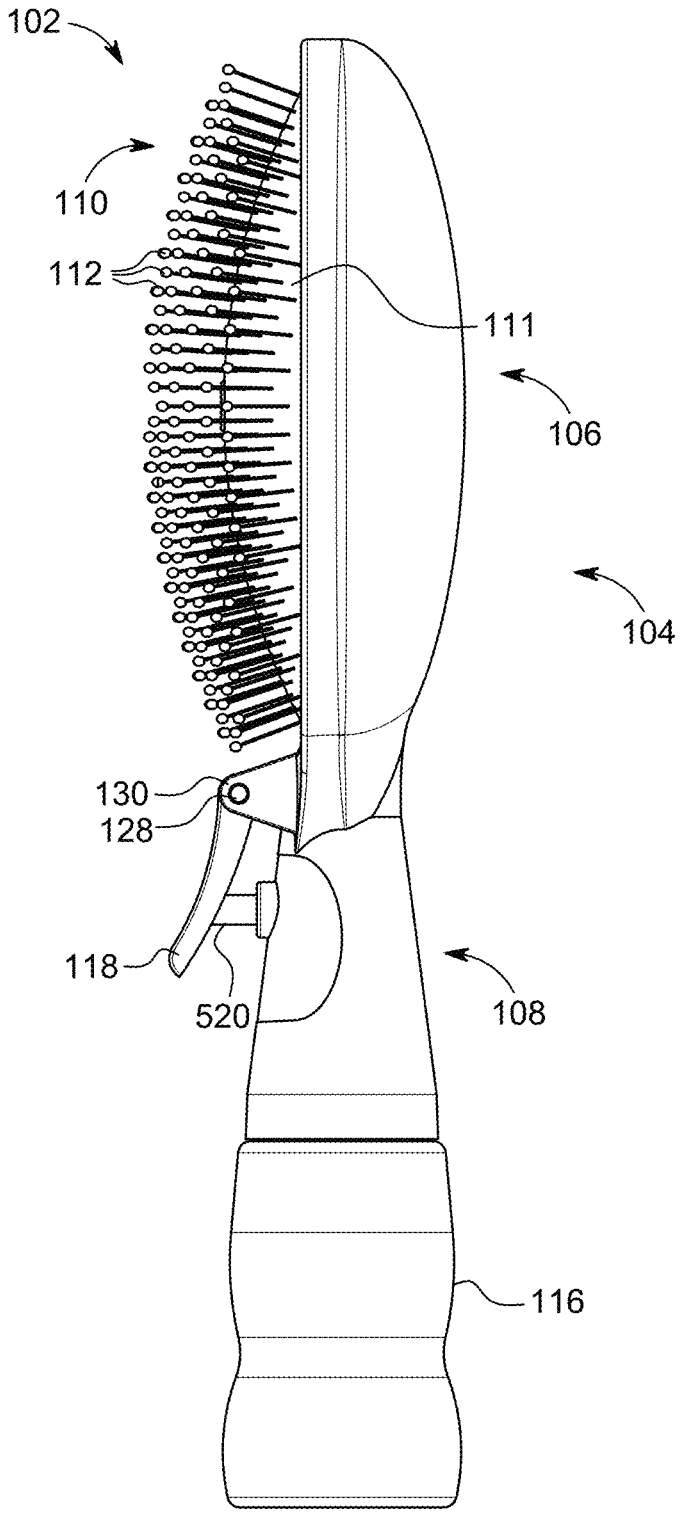
FIG. 2 is a side elevational view of the hairbrush of FIG. 1.

A first embodiment of a hairbrush in accordance with the principles of the invention is generally indicated at reference number 102 in the Figures of the attached drawings, wherein numbered elements in the Figures correspond to like numbered elements herein.

As shown in FIGS. 1-8, the hairbrush 102 includes an integrated pump 120 and spray nozzle 122 to spray a liquid 200 from a head portion 106 of the hairbrush 102. In some embodiments, the hairbrush 102 includes a brush body 104 that defines a head portion 106 and a handle portion 108. In the embodiment as shown in FIGS. 1-8, the head portion 106 and the handle portion 108 are formed as a single monolithic part. For example, the brush body 104 may be formed as a molded plastic part. It should be noted that other materials may be used to form the brush body 104. In some embodiments, the brush body 104 is formed from a metal or other non-polymer material.

The hairbrush 102 includes a bristle component 110 configured to be coupled to the head portion 106 of the brush body 104. In some embodiments, the head portion 106 defines a channel to receive the bristle component 110. In other embodiments, the bristle component 110 is attached to the head portion 106 with an adhesive or other fastener. In yet other embodiments, the bristle component 110 is formed as an integral part of the head portion 106.

The bristle component 110 includes a bristle support 111 and a plurality of bristles 112. As used herein, the term "bristle" includes natural filaments (e.g., animal hair) or synthetic filaments (e.g., polymer fibers). As used herein, the term "bristle" also includes wire pins formed from a synthetic material (e.g., nylon, metal, etc.). The pins may include a protective ball at an end located opposite the bristle support 111. In some embodiments, the bristles 112 are solid such that fluid or air does not flow through the bristles 112. It should be noted that a mixture of bristle styles may be used. For example, the bristles 112 may include nature animal hairs and wire pins.

In some embodiments, the bristle support 111 is a flexible membrane that provides for movement of the bristles 112. In some embodiments, the bristle support 111 is formed from an elastomeric material that allows for elastic deformation. The bristles 112 are attached to the bristle support 111 in an approximately orthogonal orientation. In other words, the bristles 112 project at approximately 90 degrees from the external surface of the bristle support 111. In some embodiments, the bristle support 111 forms a convex shell that projects out from the head portion 106 of the hairbrush 102. In other embodiments, the bristle support 111 substantially planar (e.g., flat).

Figure 3:
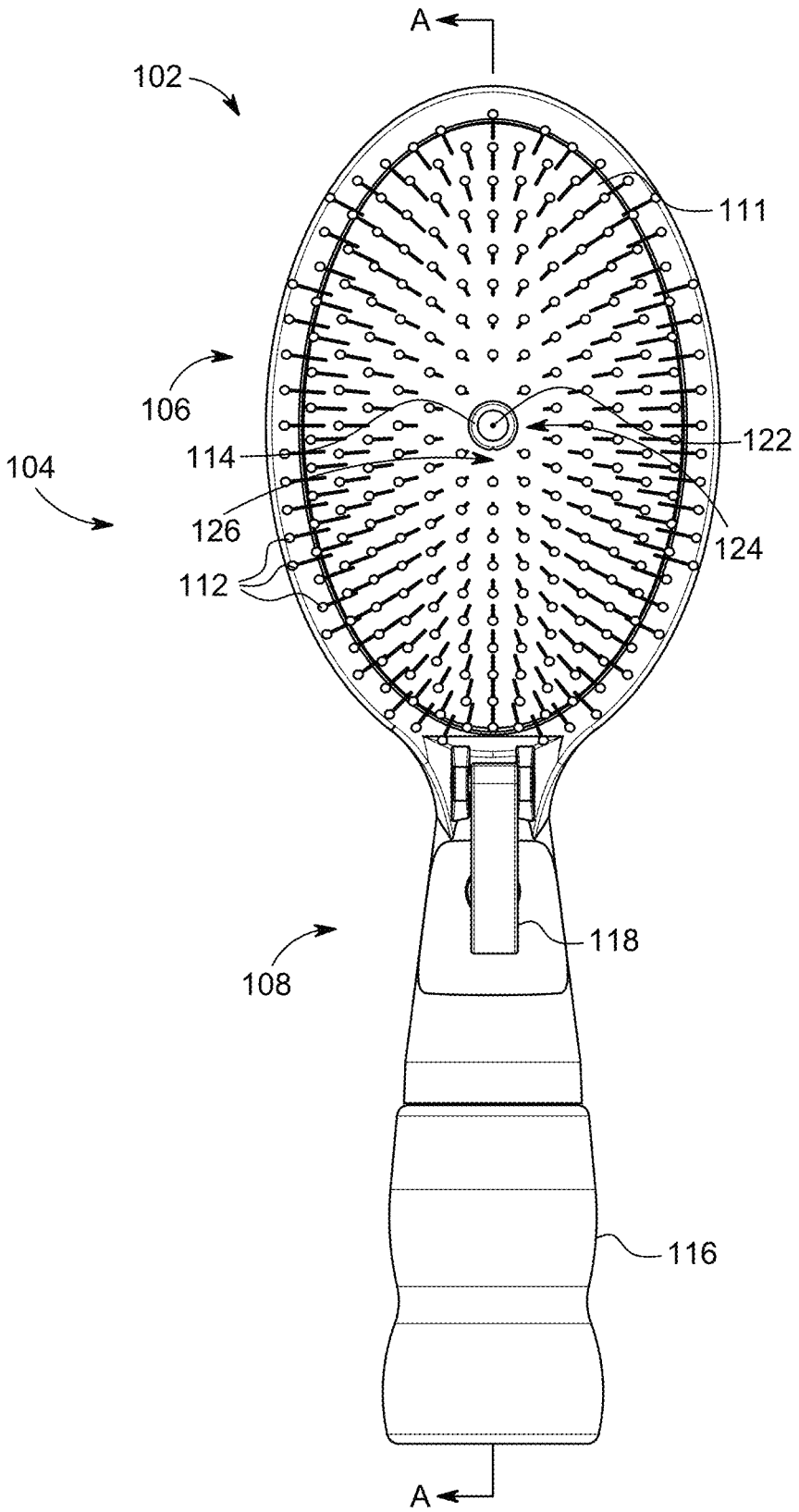
FIG. 3 is a front elevational view of the hairbrush of FIG. 1.
Figure 4:
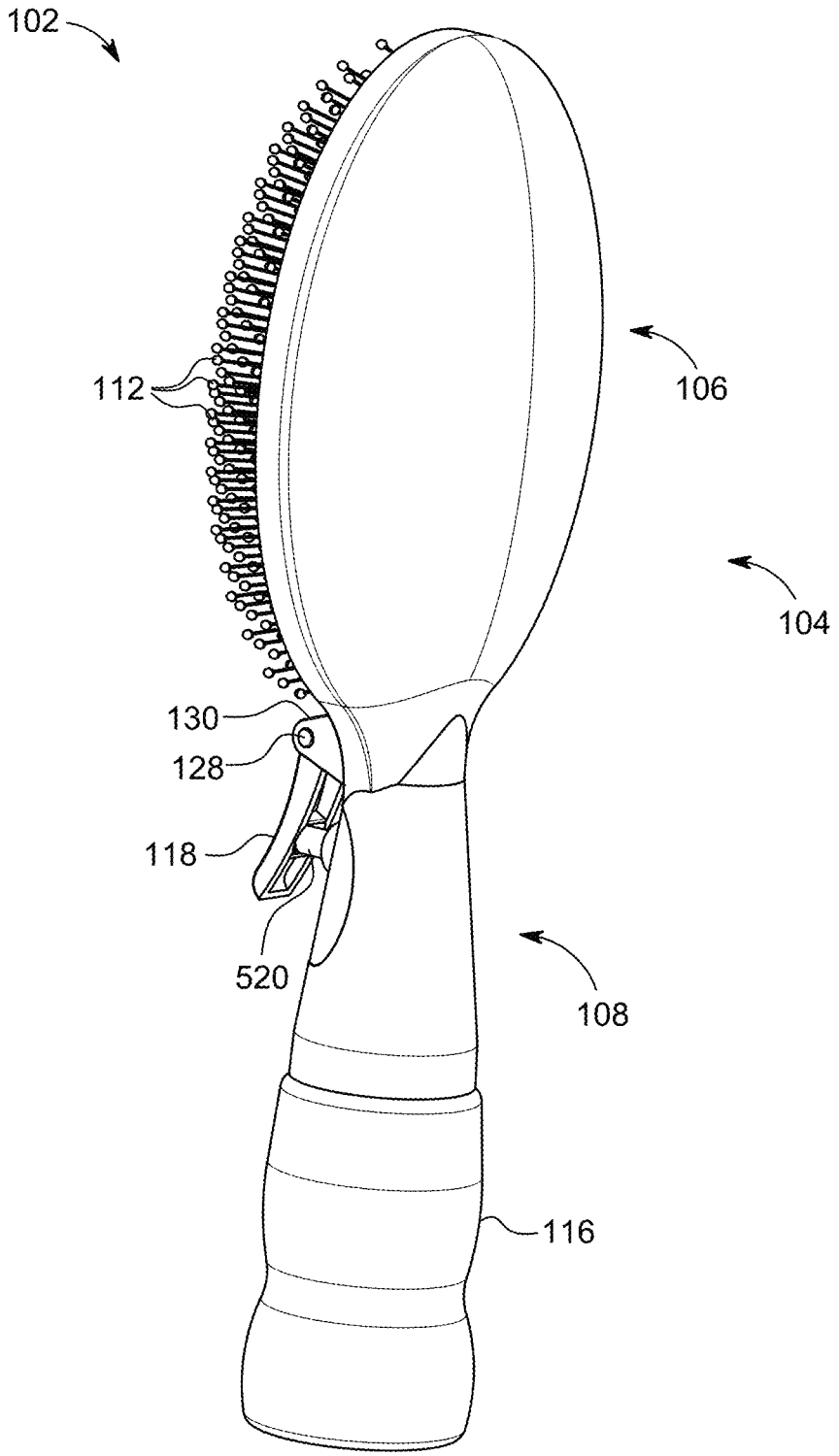
FIG. 4 is an isometric perspective rear view of the hairbrush of FIG. 1.

The bristle component 110 forms an aperture 114. As used herein, the term "aperture" refers to an opening. Thus, the aperture 114 is an opening in the bristle support 111. In some embodiments, the aperture 114 is a circular opening, though the aperture 114 may take other shapes. The aperture 114 is configured to interface with a spray nozzle 122 as will be discussed below. In some embodiments, the aperture 114 is located in a central region 124 of the bristle component 110 as shown in FIG. 3. For example, the aperture 114 may be formed approximately in the middle of the bristle support 111. In other embodiments, the aperture 114 is formed in other regions of the bristle support 111 such as a top region or bottom region. Different locations of the aperture 114 may provide different experiences when using the hairbrush 102. Therefore, a user may select a given hairbrush 102 based on the location of the aperture 114.

In some embodiments, the bristle component 110 includes a bristle-free region 126 surrounding the aperture 114, as shown in FIG. 3. The bristle-free region 126 is an area on the bristle support 111 surrounding the aperture 114 where there are no bristles 112. The bristle-free region 126 may be defined by a given offset distance away from the aperture 114 for placement of the bristles 112. In some embodiments, the size of the bristle-free region 126 is determined by the height of the bristles 112 where longer bristles 112 result in a larger bristle-free region 126. Thus, the liquid spray emitted by the spray nozzle 122 in the bristle-free region 126 is unobstructed by bristles 112. The bristle-free region 126 may allow the liquid spray from the spray nozzle 112 to travel away from the hairbrush 102 without being blocked by the bristles 112.

As discussed above, the brush body 104 includes a handle portion 108. The handle portion 108 is sized and configured to be gripped by the hand of a user. In some embodiments, the handle portion 108 is sized to allow a user to wrap their fingers around the handle portion 108 to grip the hairbrush 102.

A trigger actuator 118 is coupled to the handle portion 108. The trigger actuator 118 is a mechanism that allows a user to actuate a pump 120 of the hairbrush 102. In some embodiments, the trigger actuator 118 includes a lever configured to engage a finger of the user. In some embodiments, the trigger actuator 118 is formed with a curved surface to engage and contain the finger of a user. Thus, the user may use their index finger (also referred to as pointer finger or forefinger) to engage the trigger actuator 118. This allows for convenient and ergonomic actuation of the trigger actuator 118.

The trigger actuator 118 also includes a pivot pin 128 to allow rotation of the trigger actuator 118 about an axis. In some embodiments, the brush body 104 includes a pivot pin receiver 130, which receives the pivot pin 128 of the trigger actuator 118. The pivot pin 128, thus, may rotate within the pivot pin receiver 130. In some embodiments, the pivot pin receiver 130 may include two arms projecting out from a surface of the brush body 104. Each arm includes a cavity or hole to receive an end of the pivot pin 128. In some embodiments, the pivot pin receiver 130 may be coupled to either the handle portion 108, the head portion 106, or a combination thereof. In the embodiment shown in FIGS. 1-8, the pivot pin receiver 130 is located at a transition area between the head portion 106 and the handle portion 108, which allows a user to actuate the trigger actuator 118 while their hand is positioned on the handle portion 108 just beneath the bristle component 110. Thus, a user may comfortably use the hairbrush 102 to brush hair and actuate the trigger actuator 118 to generate a spray of liquid from the spray nozzle 122.

In some embodiments, the hairbrush 102 includes a shield 302 surrounding the pivot pin 128 of the trigger actuator 118. The shield 302 is configured to restrict hair from engaging the pivot pin 128 and becoming tangled on the pivot pin 128. Thus, the shield 302 may prevent hair from becoming stuck on the pivot pin 128 as the hairbrush 102 is being used to groom hair. In the embodiment shown in FIG. 6, the shield 302 is integrated on the pivot pin receiver 130 such that the shield 302 blocks hair from encountering the pivot pin 128.

The hairbrush 102 also includes a reservoir 116. The reservoir 116 is configured to receive a liquid 200. In some embodiments, the liquid 200 includes water or other liquid hair-styling product. In some embodiments, the reservoir 116 is configured to be removable from the handle portion 108. Thus, the reservoir 116 may be separated from the handle portion 108.

Figure 5:
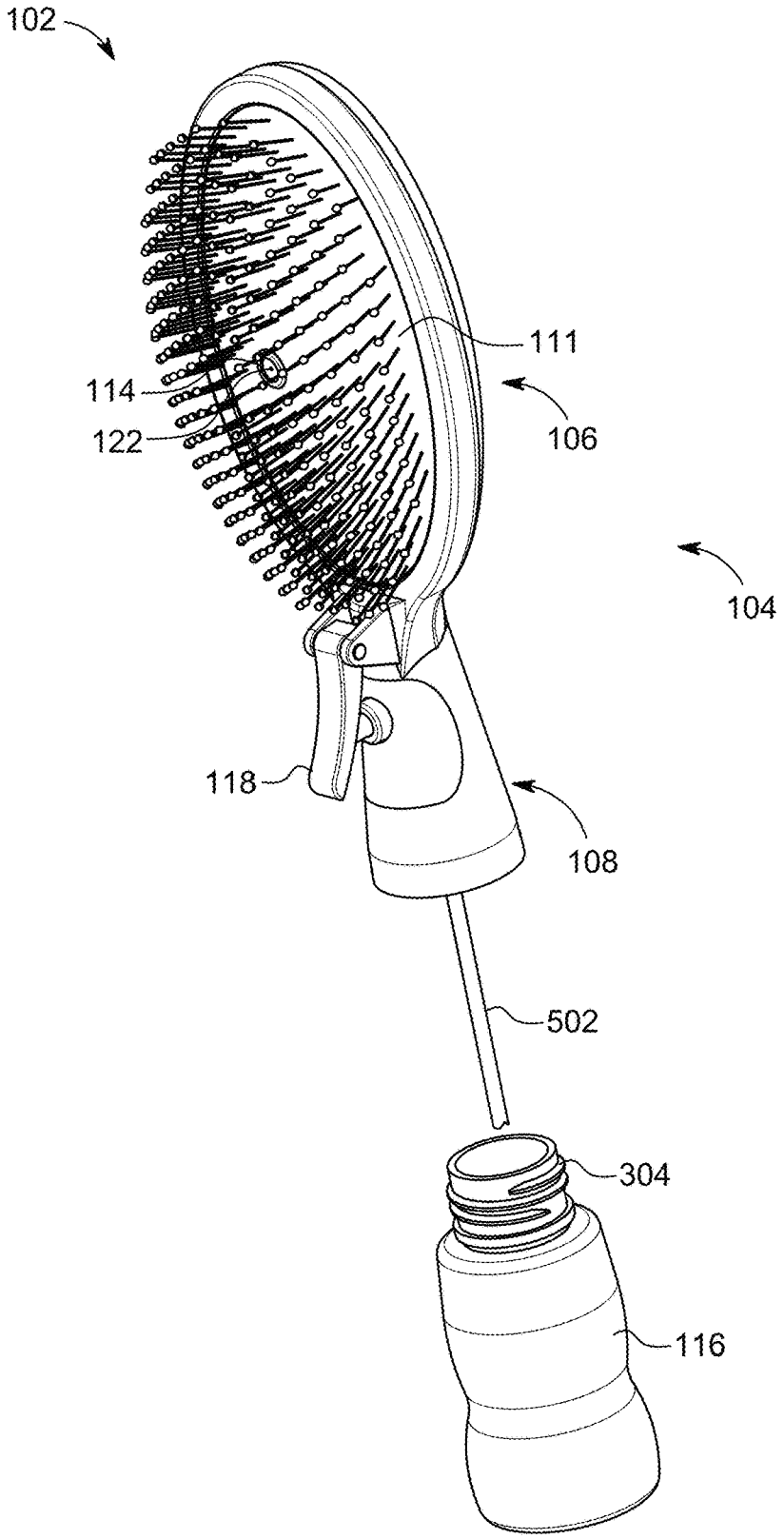
FIG. 5 is an exploded isometric perspective view of the hairbrush of FIG. 1.
Figure 7:
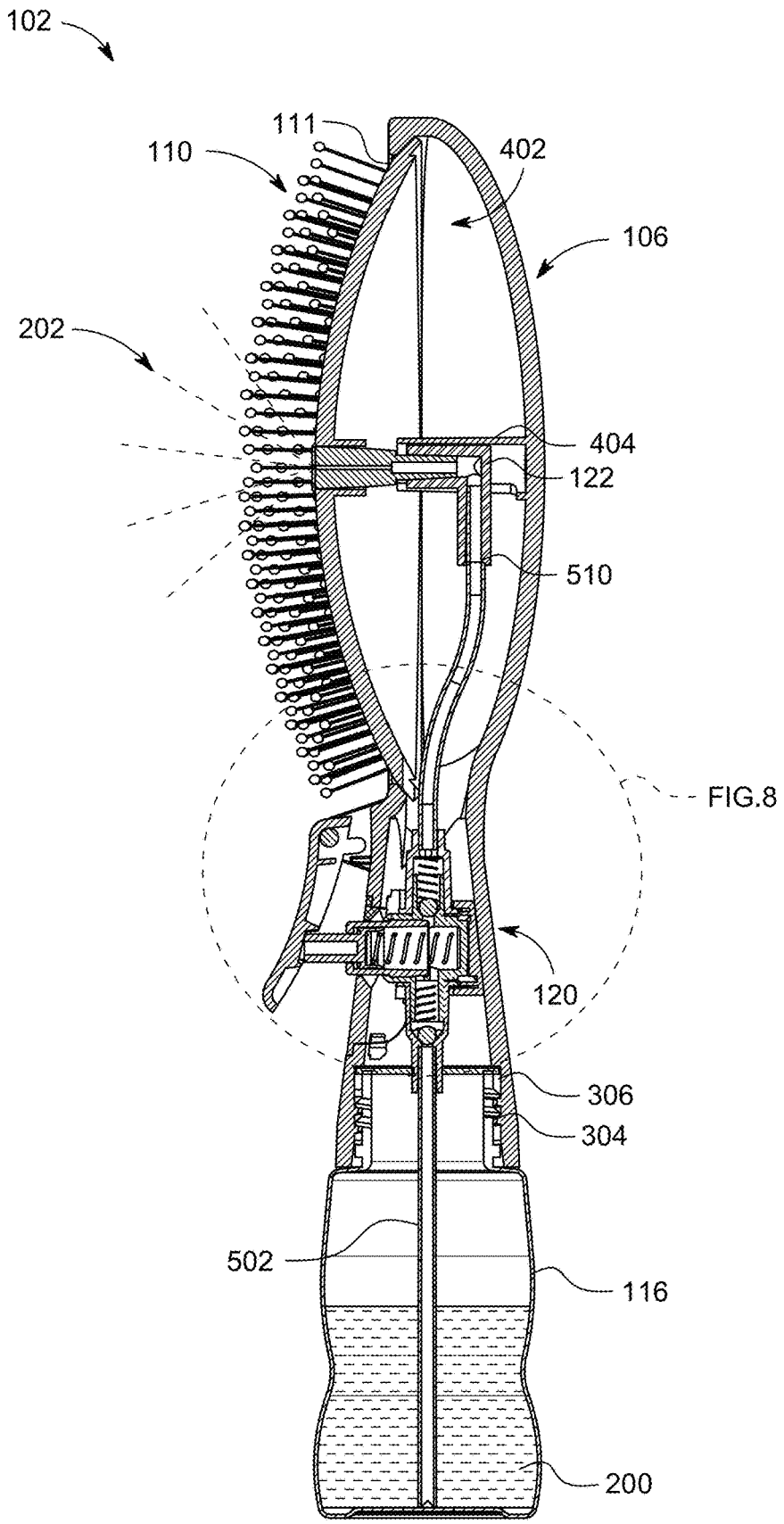
FIG. 7 is a cross-sectional view of the hairbrush of FIG. 1 taken along line A-A shown in FIG. 3.
Figure 8:
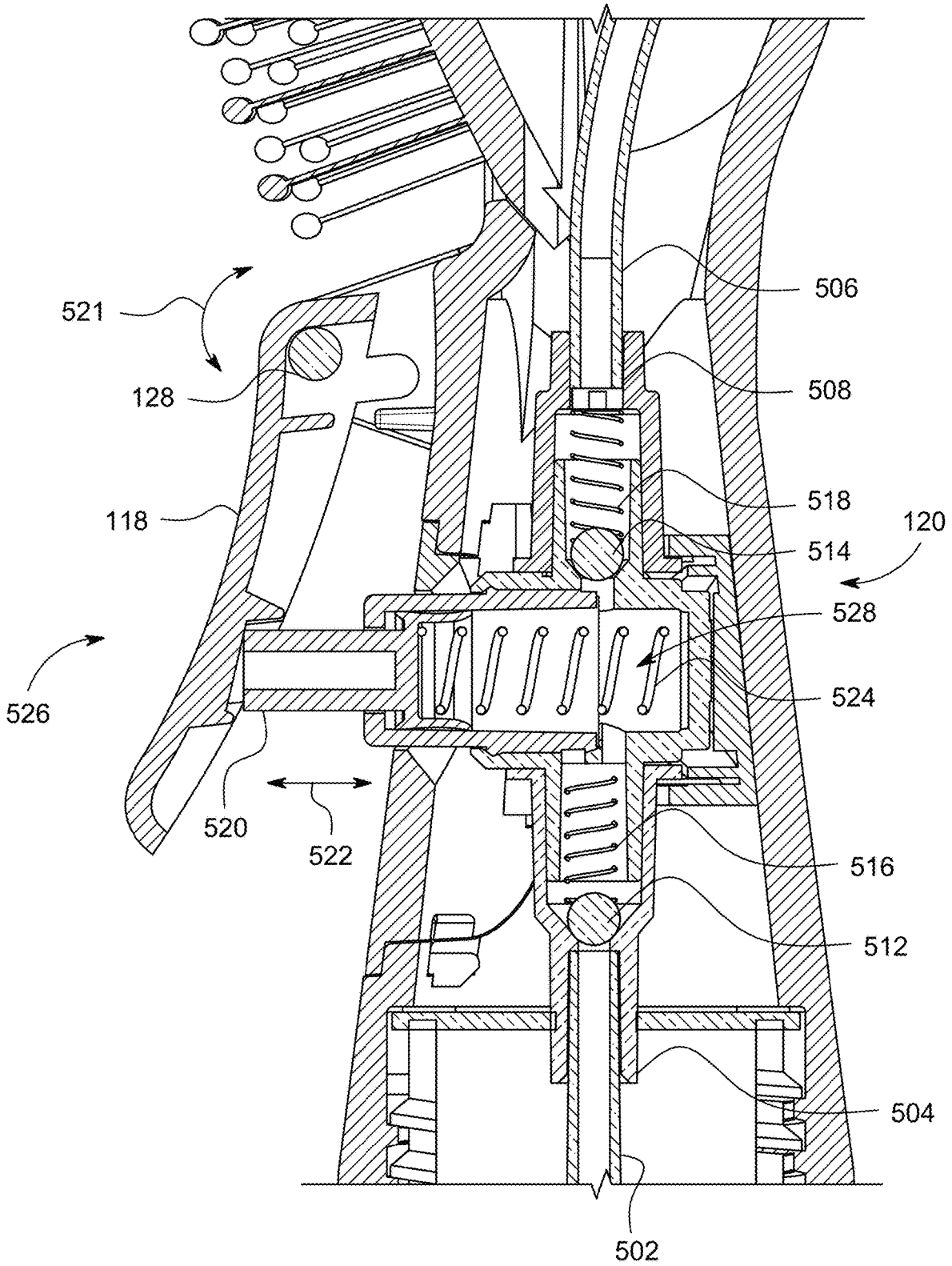
FIG. 8 is detailed view showing an embodiment of the pump of the hairbrush of FIG. 1.

The handle portion 108 includes an interface to couple to a reservoir 116. In some embodiments, an end of the handle portion 108 includes threads 306 to engage threads 304 of the reservoir 116. Thus, the reservoir 116 includes threads 304 configured to couple to threads 306 of the handle portion 108. As shown in FIGS. 5 and 7-8, the threads 304 of the reservoir 116 are external threads and the threads 306 of the handle portion 108 are internal threads. However, the arrangement of the threads 304, 306 may be reversed such that the threads 304 are internal threads and the threads 306 are external threads.

The reservoir 116, in conjunction with the handle portion 108 may form a handle to grip the hairbrush 102. For example, when attached to the handle portion 108, the exterior surface of the reservoir 116 may be configured to be gripped by the user. Thus, the reservoir 116 not only stores liquid 200, but also forms a portion of the handle of the hairbrush 102.

In other embodiments (not shown), the reservoir 116 is integrated into the handle portion 108. In this case, the handle portion 108 may form the reservoir 116 to store the liquid 200. The handle portion 108 may include an opening to receive the liquid 200.

The hairbrush 102 includes a pump 120 housed by the handle portion 108. In some embodiments, the handle portion 108 includes an internal cavity to house the pump 120. The pump 120 is actuated by the trigger actuator 118. For example, as a user depresses the trigger actuator 118, a plunger or piston 520 of the pump 120 travels along an axis 522. This motion of the piston 520 generates pressure to move the liquid 200 through the hairbrush 102. The trigger actuator 118 in some embodiments is arranged such that the piston 520 contacts the trigger actuator 118 between the proximal end portion of the trigger actuator 118 where the pivot pin 128 is located and the opposite distal end portion of the trigger actuator 118. In some embodiments, the distance between the distal edge of the trigger actuator 118 and the piston 520 or the central axis of the piston 520 along which the piston 520 translates is at least 5, 10, 15, 20, 25, or 30 percent of the distance between the distal edge of the trigger actuator 118 and the pivot pin 128 or the rotational axis of the pivot pin 128. The inventors discovered that such percent being at least approximately 25 percent provides increased control over the volume and pressure of the spray emitted from the nozzle 122. Accordingly, the trigger actuator 118 provides leverage that enables the user to more easily depress the piston 520 (i.e., with less force on the user's thumb or finger) compared to the force on the user's finger or thumb necessary to depress the piston 520 directly or by pushing a head coupled to the exposed end portion of the piston 520.

The pump 120 is configured to receive the liquid 200 from the reservoir 116. In some embodiments, the hairbrush 102 includes a first tube 502 coupled to an inlet 504 of the pump 120. The first tube 502 is configured to insert into the reservoir 116 to transmit the liquid 200 from the reservoir 116 to the pump 120. In some embodiments, the first tube 502 is configured to reach a bottom surface of the reservoir 116 such that when the hairbrush 102 is held upright and the pump 120 actuated, the first tube 502 can pull liquid 200 from the bottom of the reservoir 116. As seen in FIG. 5, the liquid 200 may be filled in the reservoir 116. The first tube 502 is then inserted into the reservoir 116 before attaching the reservoir 116 to the handle portion 108.

The pump 120 includes an outlet 508 to pass the liquid 200 to the spray nozzle 122. A second tube 506 is coupled to an outlet 508 of the pump 120 and an inlet 510 of the spray nozzle 122. The second tube 506 provides fluidic communication between the pump 120 and the spray nozzle 122. Thus, upon actuation of the pump 120, the liquid 200 is provided to the spray nozzle 122 under pressure. The spray nozzle 122 is configured to receive the liquid 200 from the pump 120 and to spray the liquid 120 in response to actuation of the trigger actuator 118 and pump 120.

Figure 6:
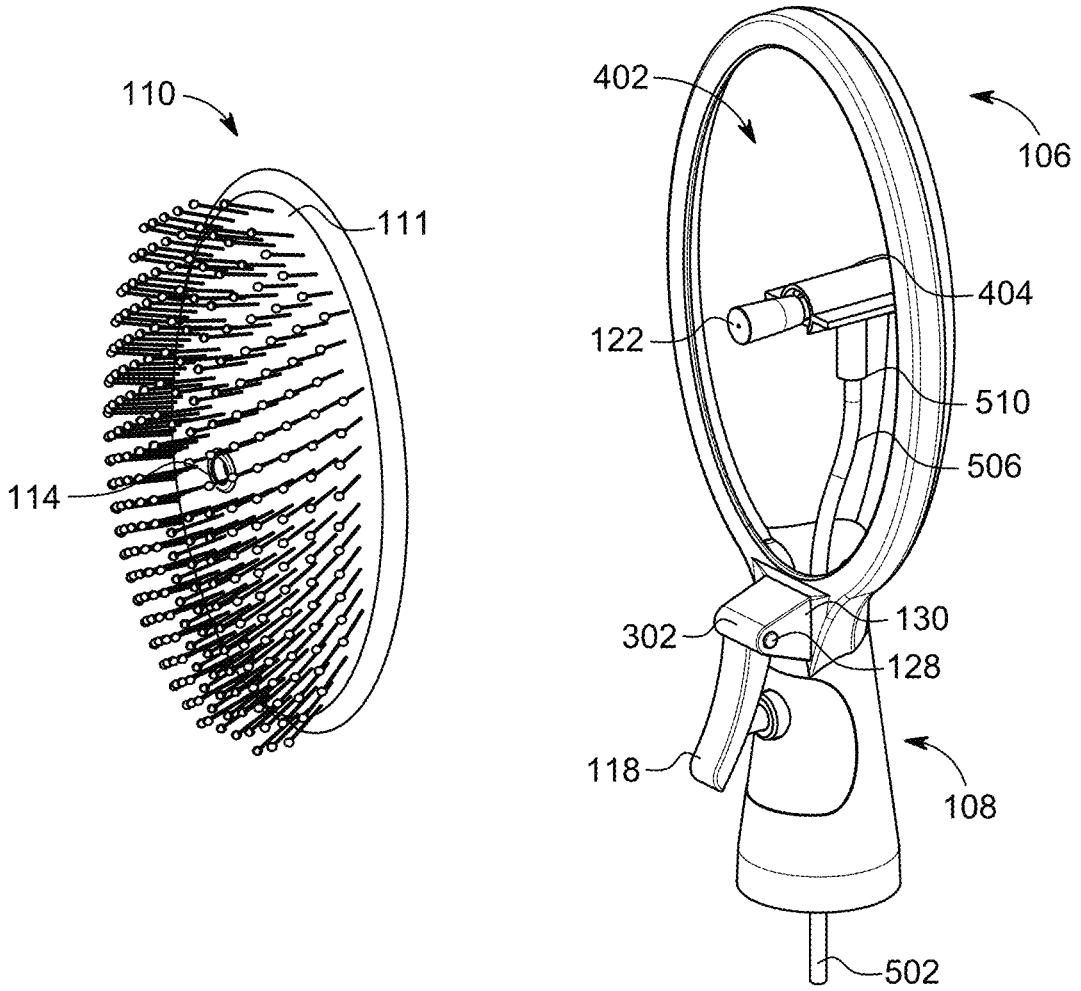
FIG. 6 is an exploded isometric perspective view of the hairbrush of FIG. 1.

The spray nozzle 122 is positioned adjacent to the aperture 114 of the bristle component 110. The head portion 106 of the brush body 104 defines an internal cavity 402, as seen in FIGS. 6-8. In some embodiments, a nozzle housing 404 is coupled to the head portion 106 within the internal cavity 402. The nozzle housing 404 is configured to couple to the spray nozzle 122 of the hairbrush 102. In other embodiments, the spray nozzle 122 and the nozzle housing 404 may be formed as an integrated unit. The aperture 114 is configured to surround a portion of the spray nozzle 122. In some embodiments, the bristle support 111 may define an internal sheath that engages the sidewall of the spray nozzle 122 in the internal cavity 402 of the hairbrush 102, as shown in FIG. 7. In some embodiments, the bristle support 111 engages the spray nozzle 122 through friction or with an adhesive.

The spray nozzle 122 is configured to receive the liquid 200 from the pump 120 and to spray the liquid 200 in response to actuation of the trigger actuator 118. In some embodiments, the spray nozzle 122 is configured to generate a mist 202 of the liquid 200. As used herein, the term "mist" refers to an aerosolized mixture of liquid droplets and air. The mist 202 projects out from the spray nozzle 122. In other embodiments, the spray nozzle 122 may emit a stream of liquid 200. In some embodiments, the spray nozzle 122 provides a single spray of the liquid 200 for the hairbrush 102. Because the spray nozzle 122 provides a single source of spray, a user of the hairbrush 102 may have a high degree of control over the placement of the spray as opposed to multiple sources of spray. For embodiments where the spray nozzle 122 is located in the central region 124 of the bristle component 110, actuating the trigger actuator 118 causes the spray nozzle 122 to generate the mist 202 in the central region 124 of the bristle component 110.

Referring now to FIGS. 7 and 8, components of the pump 120 are described. In some embodiments, the pump 120 includes a first ball 512 to allow the liquid 200 to enter the pump 120 through the inlet 504. The first ball 512 also restricts the liquid 200 from exiting through the inlet 504. A second ball 514 allows the liquid 200 to exit the pump 120 through the outlet 508. The second ball 514 also restricts the liquid 200 from entering the pump 120 through the outlet 508. A first spring 516 provides a bias to the first ball 512. A second spring 518 provides a bias to the second ball 514. The pump 120 also includes a piston 520 configured to contact the trigger actuator 118. The piston translates along an axis 522 in response to actuation (e.g., rotation 521) of the trigger actuator 118. A third spring 524 provides a bias to the piston 520 to cause the piston 520 and the trigger actuator 118 to return to a first position 526 (e.g., a non-actuated position).

When the trigger actuator 118 is actuated (e.g., pressed), the trigger actuator 118 presses the piston 520 into a pump chamber 528, forcing fluid 200 within the pump chamber to exit through the outlet 508 when the pressure inside the chamber 528 exceeds the bias force that the spring 518 applies to the outlet valve ball 514. In particular, depression of the piston 520 into the chamber 528 reduces the effective volume of the chamber 528 (i.e., the volume of the chamber 528 available to contain fluid 200 drawn from the reservoir 116), thereby increasing the pressure in the chamber 528 until the pressure therein is relieved by the outlet valve ball 524 being displaced by the fluid 200 exiting the chamber 528. Once the pressure in the chamber 528 fails to exceed the bias force that the spring 518 applies to the outlet valve ball 514, the ball 514 returns from the open configuration (not shown) to the closed configuration shown in FIG. 8.

This pressurized fluid 200 is then provided to the spray nozzle 122 to generate a spray of the fluid or liquid 200. When the user releases the trigger 118, the bias of the third spring 524 forces the piston 520 out of the pump chamber 528, which draws fluid 200 from the reservoir 116 through the inlet 504 of the pump 120. In particular, the movement of the piston 520 in the outward direction toward the trigger 118 increases the effective volume of the chamber 528, thereby decreasing the pressure in the chamber 528 until the vacuum therein applies a greater force to the inlet valve ball 512 than the spring 516, at which point the inlet valve ball 512 is displaced by the fluid 200 entering the chamber 528, thus refilling the chamber 528 for the user's next actuation of the trigger 118. Once the vacuum force on the inlet valve ball 512 that fails to exceed the outward force on the ball 512 by the spring 516, the ball 516 returns from the open configuration (not shown) to the closed configuration shown in FIG. 8. Accordingly, the chamber 528 selectively fluidly couples the reservoir to the nozzle 122 based on the configuration of the valves defined by the balls 512, 514, which is controlled by the pressure in the chamber 528, which is controlled by the movement of the piston 520.

The term "configured" as used herein means an element being one or more of sized, dimensioned, positioned, or oriented to achieve or provide the recited function or result. The term "directly coupled" as used herein means that a component contacts (for example, when bolted) or is welded to another component. The term "indirectly coupled" as used herein means that a first component is coupled to a second component by way of one or more intervening components that are directly coupled to the first and second components. For example, a first component that is indirectly coupled to a second component is directly coupled to a third component, which may be directly coupled to the second component or to a fourth component that is directly coupled to the second component. The term "coupled" should therefore be understood to disclose both direct and indirect coupling of components or elements that are described as being coupled to each other.

All values, including angles and dimensions, shown in the drawings are approximate. The term "approximate" or "substantially" for angles refers to the disclosed value of the angle or within 5, 10, 15, 20, 25, 30, 35, 40, or 45 degrees of the disclosed value. The term "approximate" or "substantially" for dimensions refers to the disclosed value of the dimension or within 5, 10, 15, 20, 30, 40, or 50 percent of the disclosed value.

As used herein, the following terms take the meanings explicitly associated herein, unless the context clearly dictates otherwise. The term "or" is an inclusive grammatical conjunction to indicate that one or more of the connected terms may be employed. For example, the phrase "one or more A, B, or C" or the phrase "one or more As, Bs, or Cs" is employed to discretely disclose each of the following: i) one or more As, ii) one or more Bs, iii) one or more Cs, iv) one or more As and one or more Bs, v) one or more As and one or more Cs, vi) one or more Bs and one or more Cs, and vii) one or more As, one or more Bs, and one or more Cs. The term "based on" as used herein is not exclusive and allows for being based on additional factors not described. The articles "a," "an," and "the" include plural references. Plural references are intended to also disclose the singular.

While the preferred embodiment of the invention has been illustrated and described, as noted above, many changes can be made without departing from the spirit and scope of the invention. For example, each disclosure of a component preferably having a feature or characteristic is intended to also disclose the component as being devoid of that feature or characteristic, unless the principles of the invention clearly dictate otherwise. Accordingly, the scope of the invention is not limited by the disclosure of the preferred embodiment. Instead, the invention should be determined entirely by reference to the claims that follow. It should also be noted that the claim dependencies or combinations of elements recited in the claims does not reflect an intention to forgo claiming other subject matter disclosed herein. Instead, this disclosure is intended to also disclose the subject matter of any combination of any two or more of the claims, such that subsequent claim sets may recite that any one of the dependent claims depends from any other one or more claims, up to and including all other claims in the alternative (for example, "The apparatus or method of any one of the preceding or subsequent claims . . . "). This disclosure is also intended to disclose the subject matter of any one of the dependent claims, as if it was an independent claim, with or without all or a portion of the subject matter of the original independent claim(s) or any other subject matter disclosed herein.

The invention claimed is:

1. A hairbrush, comprising:

a brush body including a head portion defined by a first side and an opposing second side, and a handle portion defined by a first side and an opposing second side, wherein the first side of the head portion is adjacent to the first side of the handle portion;

a bristle component coupled to the first side of the head portion of the brush body, the bristle component including a plurality of bristles extending outwardly from an outside surface of the first side of the head portion, the bristle component forming an aperture;

a reservoir coupled to the handle portion, the reservoir being configured to receive a liquid;

a pump housed within an internal cavity of the handle portion that is defined by the first side of the handle portion and the second side of handle portion, the pump being configured to receive the liquid into a pump chamber from the reservoir;

the pump comprising a plunger, wherein the plunger is defined by a proximal end coupled to the pump chamber of the pump, wherein the plunger is further defined by a distal end protruding outwardly from an outside surface of the first side of the handle portion, and wherein the plunger includes a plunger head at the distal end of the plunger;

a pivot pin;

a pivot pin receiver extending outwardly from the outside surface of the first side of the handle portion and configured to receive the pivot pin;

a trigger actuator outside of and proximate to the outside surface of the first side of the handle portion, wherein the trigger actuator is defined by a proximal end that is rotatably coupled to the pivot pin, wherein the trigger actuator is defined by a middle portion that engages the plunger head of the plunger, and wherein actuation of a distal end of the trigger actuator allows rotation of the trigger actuator about the pivot pin to urge the plunger into the chamber of the pump;

a shield surrounding at least the pivot pin, wherein the shield is configured to restrict hair from engaging the pivot pin and becoming tangled on the pivot pin; and a spray nozzle adjacent to the aperture of the bristle component, the spray nozzle being configured to receive the liquid from the pump and to spray the liquid in response to actuation of the trigger actuator.

2. The hairbrush of claim 1, wherein the spray nozzle is configured to generate a mist of the liquid.

3. The hairbrush of claim 1, wherein the aperture is located in a central region of the bristle component.

4. The hairbrush of claim 1, wherein the spray nozzle provides a single spray of the liquid for the hairbrush.

5. The hairbrush of claim 1, wherein the bristle component includes a bristle-free region surrounding the aperture, whereby the liquid spray in the bristle-free region is unobstructed by bristles.

6. The hairbrush of claim 1, wherein the reservoir is configured to be removable from the handle portion.

7. The hairbrush of claim 6, wherein the reservoir includes threads configured to couple to threads of the handle portion.

8. The hairbrush of claim 1, further comprising a nozzle housing coupled to the head portion within the internal cavity, wherein the nozzle housing is configured to couple to the spray nozzle.

9. A method of using the hairbrush of claim 1, the method comprising:

filling the reservoir with the liquid; and attaching the reservoir to the handle portion.

10. The method of claim 9, further comprising inserting a first tube coupled to an inlet of the pump into the reservoir before attaching the reservoir to the handle portion.

11. The method of claim 9, further comprising actuating the trigger actuator to cause the spray nozzle to generate a mist in a central region of the bristle component.

12. A hairbrush, comprising:

a brush body including a head portion and a handle portion, wherein the head portion and the handle portion are each defined by a first side and an opposing second side, and wherein the first side of the head portion is adjacent to the first side of the handle portion;

a bristle component coupled to the first side of the head portion of the brush body, the bristle component including a plurality of bristles extending outwardly from the first side of the head portion, the bristle component forming an aperture;

a reservoir coupled to the handle portion, the reservoir being configured to receive a liquid;

a trigger actuator coupled to an outside surface of the first side of the brush body;

a pump housed between the first side and the second side of the handle portion, the pump being actuated by the trigger actuator, the pump being configured to receive the liquid into a pump chamber from the reservoir;

a spray nozzle adjacent to the aperture of the bristle component, the spray nozzle being configured to receive the liquid from the pump and to spray the liquid in response to actuation of the trigger actuator;

a first tube coupled to an inlet of the pump, the first tube being configured to insert into the reservoir to transmit the liquid from the reservoir to the pump;

a pivot pin;

a pivot pin receiver extending outwardly from the outside surface of the first side of the handle portion and configured to receive the pivot pin; and a shield surrounding at least the pivot pin, wherein the shield is configured to restrict hair from engaging the pivot pin and becoming tangled on the pivot pin.

13. The hairbrush of claim 12, further including a second tube coupled to an outlet of the pump and an inlet of the spray nozzle, the second tube providing fluidic communication between the pump and the spray nozzle.

14. The hairbrush of claim 12, wherein the pump includes:

a first ball to allow the liquid to enter the pump through the inlet and to restrict the liquid from exiting through the inlet.

15. The hairbrush of claim 14, wherein the pump further includes:

a second ball to allow the liquid to exit the pump through the outlet and to restrict the liquid from entering the pump through the outlet.

16. The hairbrush of claim 15, wherein the pump further includes:

a first spring to provide a bias to the first ball; and a second spring to provide a bias to the second ball.

17. The hairbrush of claim 16, wherein the pump includes:

a piston configured to contact the trigger actuator, the piston to translate along an axis in response to actuation of the trigger actuator; and a third spring to provide a bias to the piston to cause the trigger actuator to return to a first position.

18. The hairbrush of claim 12, wherein the pump further comprises a plunger defined by a proximal end coupled to the pump chamber of the pump and defined by a distal end protruding outwardly from an outside surface of the first side of the handle portion, and wherein the plunger includes a plunger head at the distal end of the plunger; and wherein the hairbrush further comprises:

a trigger actuator outside of and proximate to the outside surface of the first side of the handle portion, wherein the trigger actuator is defined by a proximal end that is rotatably coupled to the pivot pin, wherein the trigger actuator is defined by a middle portion that engages the plunger head of the plunger, and wherein actuation of a distal end of the trigger actuator allows rotation of the trigger actuator about the pivot pin to urge the plunger into the chamber of the pump.

* * * * *